US008371040B2

(12) United States Patent
Köhne et al.

(10) Patent No.: US 8,371,040 B2
(45) Date of Patent: Feb. 12, 2013

(54) COVER FOR A CLOTHES DRYER AND ASSEMBLING METHOD THEREOF

(75) Inventors: Jens Köhne, Kandel (DE); Ian Hopkin, Cowbridge (GB); Stephen Jones, Penarth (GB)

(73) Assignee: DBK David + Baader GmbH, Kandel/Pfalz (DE)

( * ) Notice: Subject to any disclaimer, the term of this patent is extended or adjusted under 35 U.S.C. 154(b) by 95 days.

(21) Appl. No.: 10/999,813

(22) Filed: Nov. 29, 2004

(65) Prior Publication Data

US 2005/0217138 A1 Oct. 6, 2005

(30) Foreign Application Priority Data

Dec. 2, 2003 (EP) ..... 03027650

(51) Int. Cl.
*F26B 11/00* (2006.01)

(52) U.S. Cl. ..... 34/443; 34/602

(58) Field of Classification Search ..... 34/595, 34/601, 602, 606, 610, 413, 381, 443
See application file for complete search history.

(56) References Cited

U.S. PATENT DOCUMENTS

| | | | | | |
|---|---|---|---|---|---|
| 2,018,505 | A | * | 10/1935 | Suhr | 432/176 |
| 2,314,762 | A | * | 3/1943 | Boltz | 211/199 |
| 2,589,284 | A | * | 3/1952 | O'Neil | 34/77 |
| 2,619,734 | A | * | 12/1952 | Geldhof et al. | 34/546 |
| 2,742,708 | A | * | 4/1956 | McCormick | 34/76 |
| 2,748,496 | A | * | 6/1956 | Hellyer | 34/603 |
| 2,775,047 | A | * | 12/1956 | Morrison | 34/543 |
| 2,936,527 | A | * | 5/1960 | Hutt | 34/549 |
| 2,949,679 | A | * | 8/1960 | MacCracken et al. | 34/598 |
| 3,002,288 | A | * | 10/1961 | Conlee | 34/527 |
| 3,039,285 | A | * | 6/1962 | Smith | 68/19.2 |
| 3,292,769 | A | | 12/1966 | Zuppiger | 198/110 |
| 3,293,769 | A | * | 12/1966 | Graham | 34/527 |
| 3,449,838 | A | * | 6/1969 | Chancellor, Jr. | 34/90 |
| 3,545,235 | A | * | 12/1970 | Menk | 68/19.2 |
| 3,571,941 | A | * | 3/1971 | Garfield et al. | 34/527 |
| 3,621,202 | A | * | 11/1971 | Gemert | 219/492 |
| 3,799,387 | A | | 3/1974 | Zenz | |

(Continued)

FOREIGN PATENT DOCUMENTS

| | | |
|---|---|---|
| CH | 240775 | 1/1946 |
| DE | 1 585 978 | 11/1969 |

(Continued)

OTHER PUBLICATIONS

Hotpoint 6 Kg Condenser Tumble Dryer, Service Information No. 5405770, Issue 2, Nov. 2001.

(Continued)

*Primary Examiner* — Stephen M. Gravini
(74) *Attorney, Agent, or Firm* — Seed IP Law Group PLLC

(57) ABSTRACT

Embodiments of the invention relate to a cover for a dryer. The dryer is adapted, when in operation, to heat a gas stream. The dryer includes a cover mounted to at least one section of an outer wall of the dryer, in particular a rear wall of the dryer. A passage through which the gas stream can flow is formed, at least sectionwise, by the cover. The cover can include a heating unit having at least one heating element such that the gas stream flows around the heating element when the dryer is in operation.

20 Claims, 4 Drawing Sheets

U.S. PATENT DOCUMENTS

| | | | | | |
|---|---|---|---|---|---|
| 3,816,706 | A | | 6/1974 | Meywald | 219/537 |
| 3,842,319 | A | * | 10/1974 | Perl | 219/260 |
| 3,928,910 | A | * | 12/1975 | Perl | 29/854 |
| 3,975,832 | A | * | 8/1976 | Mori et al. | 34/562 |
| 4,019,023 | A | | 4/1977 | Marzonie et al. | |
| 4,025,754 | A | * | 5/1977 | Marzonie et al. | 219/400 |
| 4,041,614 | A | * | 8/1977 | Robinet | 34/92 |
| 4,063,590 | A | | 12/1977 | McConnell | 165/135 |
| RE29,853 | E | * | 11/1978 | Perl | 219/270 |
| 4,207,686 | A | * | 6/1980 | Daily | 34/610 |
| 4,474,109 | A | * | 10/1984 | Yara | 101/115 |
| 4,513,545 | A | * | 4/1985 | Hopkins, Jr. | 52/79.1 |
| 4,638,573 | A | * | 1/1987 | Nakamura et al. | 34/82 |
| 4,653,200 | A | * | 3/1987 | Werner | 34/82 |
| 4,700,495 | A | * | 10/1987 | Drews et al. | 34/603 |
| 4,857,707 | A | | 8/1989 | Dall | |
| 4,994,654 | A | | 2/1991 | St. Louis | 219/532 |
| 5,134,270 | A | | 7/1992 | Bragg et al. | 219/532 |
| 5,161,314 | A | * | 11/1992 | Souza | 34/493 |
| 5,443,541 | A | * | 8/1995 | St. Louis | 34/486 |
| 5,557,704 | A | * | 9/1996 | Dennis et al. | 392/480 |
| 5,560,120 | A | | 10/1996 | Swanson et al. | 34/82 |
| 6,108,940 | A | | 8/2000 | St. Louis | |
| 6,161,310 | A | * | 12/2000 | Tuggle et al. | 34/480 |
| 6,519,871 | B2 | * | 2/2003 | Gardner et al. | 34/497 |
| 6,654,549 | B1 | * | 11/2003 | Konishi | 392/407 |
| 6,807,751 | B2 | * | 10/2004 | Han et al. | 34/601 |
| 6,845,217 | B2 | * | 1/2005 | Konishi | 392/407 |
| 7,161,120 | B1 | * | 1/2007 | Stroud et al. | 219/386 |
| 7,184,656 | B2 | * | 2/2007 | Konishi | 392/407 |
| 7,220,365 | B2 | * | 5/2007 | Qu et al. | 252/70 |
| 2003/0066638 | A1 | * | 4/2003 | Qu et al. | 165/186 |
| 2004/0037542 | A1 | * | 2/2004 | Kanishi | 392/407 |
| 2004/0096202 | A1 | * | 5/2004 | Konishi | 392/407 |
| 2004/0139627 | A1 | * | 7/2004 | Han et al. | 34/601 |
| 2004/0262293 | A1 | * | 12/2004 | Riddle et al. | 219/497 |
| 2005/0217138 | A1 | * | 10/2005 | Kohne et al. | 34/603 |
| 2005/0252033 | A1 | * | 11/2005 | Loesch et al. | 34/604 |
| 2006/0034593 | A1 | * | 2/2006 | Rapoza | 392/350 |
| 2007/0006479 | A1 | * | 1/2007 | Salgado-Mangual | 34/134 |
| 2007/0062513 | A1 | * | 3/2007 | Gagas | 126/299 D |
| 2007/0261997 | A1 | * | 11/2007 | Cassady et al. | 209/3.3 |
| 2008/0124667 | A1 | * | 5/2008 | Schultz | 431/18 |
| 2008/0124668 | A1 | * | 5/2008 | Schultz et al. | 431/89 |
| 2008/0163510 | A1 | * | 7/2008 | Dittmar et al. | 34/108 |
| 2009/0010801 | A1 | * | 1/2009 | Murphy et al. | 422/4 |

FOREIGN PATENT DOCUMENTS

| | | | |
|---|---|---|---|
| DE | 41 39 588 | | 6/1992 |
| DE | 34 19 743 | | 10/1993 |
| DE | 43 27 916 | | 2/1994 |
| DE | 198 42 644 | | 3/2000 |
| EP | 0 344 549 | A1 | 12/1989 |
| EP | 0 352 499 | | 1/1990 |
| EP | 0 352 499 | A2 | 1/1990 |
| EP | 0 344 549 | | 3/1993 |
| EP | 0 576 825 | A1 | 1/1994 |
| EP | 0 576 825 | | 10/1996 |
| GB | 1 482 520 | | 8/1977 |
| JP | 53120053 | | 10/1978 |
| JP | 55070420 | | 5/1980 |
| JP | 56130192 | | 10/1981 |
| JP | 56130192 | A | 10/1981 |
| JP | 56173194 | U | 12/1981 |
| JP | 0029788 | | 8/1987 |
| JP | 2000317200 | | 11/2000 |
| JP | 2000317200 | A | 11/2000 |
| WO | WO 2004/042132 | | 5/2004 |

OTHER PUBLICATIONS

Hotpoint 5 kg Tumble Dyers, Service Information No. 5405060, Issue 1, Feb. 2000.

Hotpoint—Ultima Condenser Tumble Dryer 6 Kg, Service Information No. 5402051, Issue 2, Oct. 1999.

Hotpoint Reversomatic Condenser Dryer Plus 6 Kg Tumble Dryer, Service Information No. 5402050, Issue 1, Aug. 1996.

Tumble Dryers, Service Information No. 9690677, Mar. 1989.

Mica Wikipedia Definition, http://en.wikipedia.org/w/index/php?title=Mica&printal, download date unknown.

* cited by examiner

COVER FOR A CLOTHES DRYER AND ASSEMBLING METHOD THEREOF

BACKGROUND OF THE INVENTION

1. Field of the Invention

The present invention generally relates to a cover for a clothes dryer, said dryer being adapted, when in operation, to heat a stream of gaseous material or gas stream for drying wet clothes, said cover being formed as at least one section of an outer wall, in particular a rear wall, of said dryer, and a passage through which the gas stream can flow being formed, at least sectionwise, by said cover.

2. Description of the Related Art

Normally, clothes dryers are manufactured by securing to a basic frame a rotatable drum with a drive means, together with an air supply and heating elements for said air supply, and by mounting then the walls on said basic frame. The gas stream is conducted from the air supply through a passage for drying the clothes, said gas stream being simultaneously heated by the heating element in said passage. When the walls have been mounted, this passage is located in the interior of the dryer and is, at least sectionwise, limited by a wall, typically the rear wall of the dryer.

Due to this arrangement, the dryer is difficult to assemble and maintenance work at the air supply and the heating element is often problematic.

Facing these problems, it is the object of the present invention to reduce the production costs and to improve the ease of assembly of the clothes dryer.

BRIEF SUMMARY OF THE INVENTION

According to the present invention, a cover for a clothes dryer is adapted as a heating unit having integrated therein at least one heating element such that the gas stream can flow around said heating element when the clothes dryer is in operation.

This solution is structurally simple and has the advantage that the cover can be pre-assembled as a heating unit and allows the at least one heating element to be installed and removed more easily in comparison with the prior art. The amount of assembly work and consequently also the production costs for the dryer can be reduced by this solution.

Due to the fact that the cover is implemented as a heating unit according to the present invention, the heating element is automatically dismantled when the cover is removed and is thus easily accessible.

In addition, the solution according to the present invention allows to dispense with a heating element housing which is installed separately in the dryer and is used in dryers according to the prior art. This has the effect that material is saved, whereby the production costs of the clothes dryer are reduced still further. Furthermore, in known dryers the housing of the heating element forms flow separation edges, e.g. at the openings in the housing. Without the housing, the so far accepted flow separation edges are avoided, whereby the air flow will be improved. In addition, due to the fact that the cover has a double function as cover and as heating element, the construction space that has hitherto been used in the interior of the dryer for the heater and the passages will become free when the solution according to the present invention is used, so that e.g. a larger drum, which is normally arranged in front of the heating unit, can be employed.

The cover according to the present invention can be further developed in the form of different, independent embodiments which are each advantageous on their own. These embodiments and the respective advantages provided thereby will be discussed briefly in the following.

In accordance with one embodiment, the cover can, for example, comprise fastening means by which said cover can be attached, preferably in a releasable manner, to the dryer from outside. This has the advantage that the cover can be mounted on the dryer easily and rapidly. Furthermore, the fastening means of the cover can be adapted as a detent or locking mechanisms by which the cover can be locked in position on the dryer, said locking engagement being preferably of a releasable nature. In the case of this embodiment, the cover can be attached to the dryer even more rapidly whereby the assembly time and consequently the assembly costs will be reduced to a substantial extent, since prior art covers are secured in position with a large number of screw connections in a time- and cost-intensive manner.

In order to prevent the gas stream flowing in the dryer from escaping to the surroundings, the cover can comprise a sealing lip by which said cover can be attached to the dryer in a substantially gas-tight manner. The sealing lip can be produced from an elastic plastic material so that material tolerances on the cover as well as on the dryer can be compensated. In an exemplary embodiment, the cover can be sealed with a labyrinth seal. In addition, the labyrinth seal can be surrounded by a labyrinth arrangement to produce an additional sealing effect.

In accordance with another embodiment, the cover can be provided with a flange area by which said cover can be mounted on the dryer. A flange area has the advantage that it can be adapted with a comparatively large surface and that said large flange area can be used as a sealing surface or for the purpose of attaching fastening means. The flange area may also be used as an adhesive area for mounting the cover on the dryer by means of an adhesive.

In accordance with a further embodiment, the cover can be produced from an electrically insulating material. By this the effect that the electrically operated heating element is insulated and no current can flow to the outside. In addition, the risk of an electric shock in the case of contact with the cover of the dryer is avoided and the existing safety guidelines are observed. This embodiment of the cover according to the present invention additionally prevents undesired electric effects, such as a possible conduction of creeping currents. As far as thermal and electric insulation are concerned, prior art dryers are adapted such that the heating unit is encompassed by a separate housing and additionally covered by the rear wall; in comparison with the solution according to the present invention, this requires more material and entails higher costs.

In order to be able to control the temperature of the gas stream with the heating element, the cover adapted as a heating unit can comprise at least one sensor by means of which the temperature of the gas stream can be measured. This allows the gas stream to be measured e.g. in front of and/or behind the heating element so as to control the supply of power to the heating element and heat the gas stream optimally in this way. A sensor can also be used as a safety thermostat of the heating element, whereby overheating of said heating element can be prevented. The sensor may be arranged e.g. in the area of the passage.

One problem of today's clothes dryers is that, due to the limited construction space in the interior of the dryer, the thermal energy of the heating element tends to be conducted to the periphery. This leads to a low efficiency in the gas stream heating process. In addition, the danger exists that the outer surfaces of the dryer will be heated to such an extent that a user may burn himself if he touches these surfaces.

Thus, in one embodiment, the cover is produced from a heat-insulating material having a low thermal conductivity to prevent the thermal energy produced by the heating element from being conducted to the periphery. This will prevent a waste of thermal energy and, in addition, the outer surfaces of the cover will not be heated to such an extent that users who touch said cover run the risk of burning themselves. Prescribed safety guidelines with regard to the admissible external temperature of the dryer can be observed more easily in this way and, in particular, the amount of energy consumed will be reduced. Additionally or alternatively, the cover can be produced from a temperature-resistant material. The heat insulation can also be improved by providing additional protective areas of heat-resistant materials on areas where high temperatures occur.

In accordance with another embodiment, the heating unit can comprise a heat protection body which surrounds the at least one heating element at least partially and protects the surroundings against the effect of heat. This has the advantage that additional heat protection of the heating unit towards the outside is provided to prevent undesired heating of the surroundings of the cover towards the outside as well as towards the interior of the dryer. This embodiment provides a simple possibility of guaranteeing, even in the case of temperatures of up to approx. 600° C. prevailing in the interior of the heating unit, an external temperature of approx. 85° C. of the outer wall that is admissible according to the existing safety regulations for clothes dryers.

In yet another embodiment, the heat protection body can define a flow passage through which the gas stream can flow. By means of said flow passage the gas stream is conducted accurately and with little losses to the at least one heating element so that an effective heating of the gas stream is guaranteed. In addition, after having flown through the heating unit, the gas stream is conducted through said flow passage into the drum of the dryer with little flow losses, which means that the thermal energy produced is supplied to the clothes in an effective and energy-saving mode. In order to achieve a good heat transfer between the heating element and the gas stream, the heating element can be arranged in the flow passage.

In order to prevent the thermal energy of the heating element from being dissipated to the surroundings, the heat protection body can be produced from a heat-insulating and temperature-resistant material, preferably from a plastic material.

The heat protection body may also be produced from a metal. The metallic heat protection body has the advantage that it can be produced simply and at a reasonable price, e.g. by deep drawing. In addition, the heat protection body may be produced from a corrosion-resistant material, e.g. a chrome nickel steel, so as to prevent corrosion of said heat protection body, which is exposed to e.g. moisture in the dryer.

In yet another embodiment, the cover includes additional fastening means for releasably attaching the heat protection body to the cover. This has the advantage that the heat protection body can be mounted easily on the cover without any additional fastening means being necessary, whereby the assembly and production costs of the heating unit will be reduced.

In accordance with another advantageous embodiment, the cover can have integrated therein at least one contact element by which the heating unit is electrically connectable to a mating contact provided on the machine side. This has the advantage that the heating unit can easily be connected to a power supply unit before it is mounted on the dryer. Furthermore, the contact element can be adapted as part of a plug connection, whereby a fast and simple connection of said contact element will be guaranteed. The heating unit can also be connected by a single, possibly standardized connector element, whereby the time required for connection will be reduced still further. The different electric lines of the at least one heating element and of the at least one sensor are then connected in said one connector element. The connector element is inserted into a complementary mating connector element of the clothes dryer.

Additionally or alternatively, the contact element can also be integrated in the cover so as to simplify the mounting of the cover on the dryer still further.

In order to be able to produce the cover at a reasonable price and with high dimensional accuracy, said cover can be constructed in the form of a receptacle-shaped housing which is implemented as an injection-moulded part. Injection-moulded parts can be produced with high dimensional accuracy and, when produced in high numbers of pieces, they are very moderate in price. Due to the receptacle-shaped design of the housing, e.g. with a high edge, the cover can be attached to a flat wall, in spite of the arranged individual components of the heating unit, and, in the attached condition, it defines a passage through which the gas stream can flow.

According to one embodiment, the receptacle-shaped housing can be implemented as a plastic component which is, in certain sections thereof, provided with at least one protective area produced from a different material, preferably a metal sheet. The combination of plastic material and of other materials improves e.g. the stability and the temperature-resistance of the housing. These other materials can be arranged both on the plastic component and in a layer manner inside said plastic component. Furthermore, the at least one protective area can be arranged in a region where high temperatures occur when the dryer is in operation. This will improve the heat insulation and the temperature resistance of the housing.

In accordance with another advantageous embodiment, the cover can be attached to the dryer from outside. This has the advantage that it will be particularly simple to mount the thus designed cover on the dryer.

The present invention concerns, in addition to the above-described cover and the embodiments of said cover, also a clothes dryer for drying wet clothes in a gas stream, said dryer being adapted such that it comprises walls, an air supply, and a passage through which said gas stream can flow. In order to facilitate the assembly of the clothes dryer, said dryer comprises a cover according to one of the above-mentioned embodiments and the passage is formed, at least sectionwise, by said cover.

The present invention concerns, in addition to the above-described devices and the further developments of said devices, also a method for assembling a clothes dryer, said dryer being adapted, when in operation, to heat a gas stream for drying wet clothes. In order to reduce the time required for assembling the dryer, the present invention is so conceived that a cover is pre-assembled to form a heating unit by attaching thereto at least one heating element, that a passage is formed, that the cover is attached from outside to a wall of the dryer, and that said passage is connected to an air supply of the dryer.

In accordance with an advantageous further development, the cover can be attached to the wall by bringing it into releasable or non-releasable locking engagement with said wall, so as to simplify the assembly of the dryer. For the same reason, when the cover is attached to the wall, a contact for supplying power to the heating element can be closed simultaneously. Further, when the cover is attached to the wall of the dryer, the passage can simultaneously be sealed in a substantially gas-tight manner.

In the following, the present invention will be explained exemplarily by also referring to the drawings enclosed. The various features can be combined independently of one another, as has already been explained hereinbefore in connection with the various advantageous embodiments.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well known structures associated with dryers and dryer assemblies have not been shown or described in detail to avoid unnecessarily obscuring descriptions of the embodiments of the invention.

Unless the context requires otherwise, throughout the specification and claims which follow, the word "comprise" and variations thereof, such as, "comprises" and "comprising" are to be construed in an open, inclusive sense, that is as "including, but not limited to."

Figure 1:
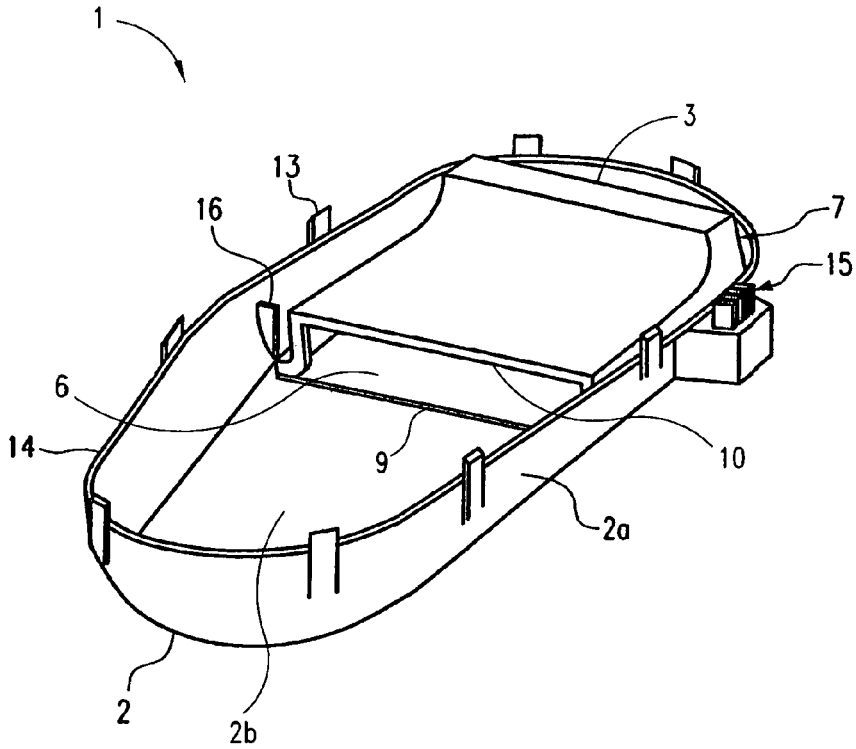
FIG. 1 shows a perspective view of an exemplary embodiment of the cover according to the present invention, in a schematic view from above.
Figure 2:
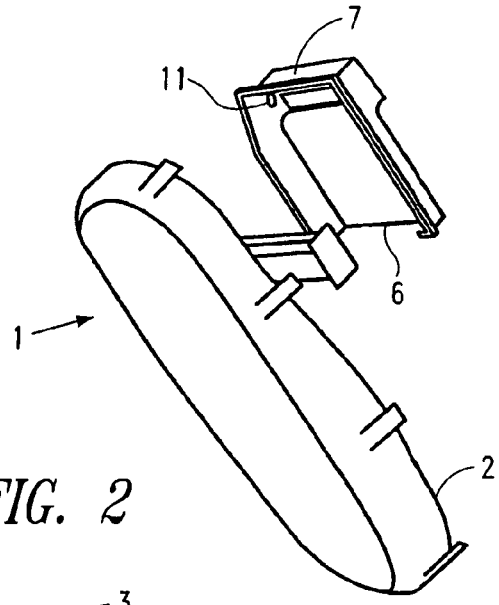
FIG. 2 shows a perspective exploded view of the cover according to the present invention shown in FIG. 1, in a schematic view from below.
Figure 3:
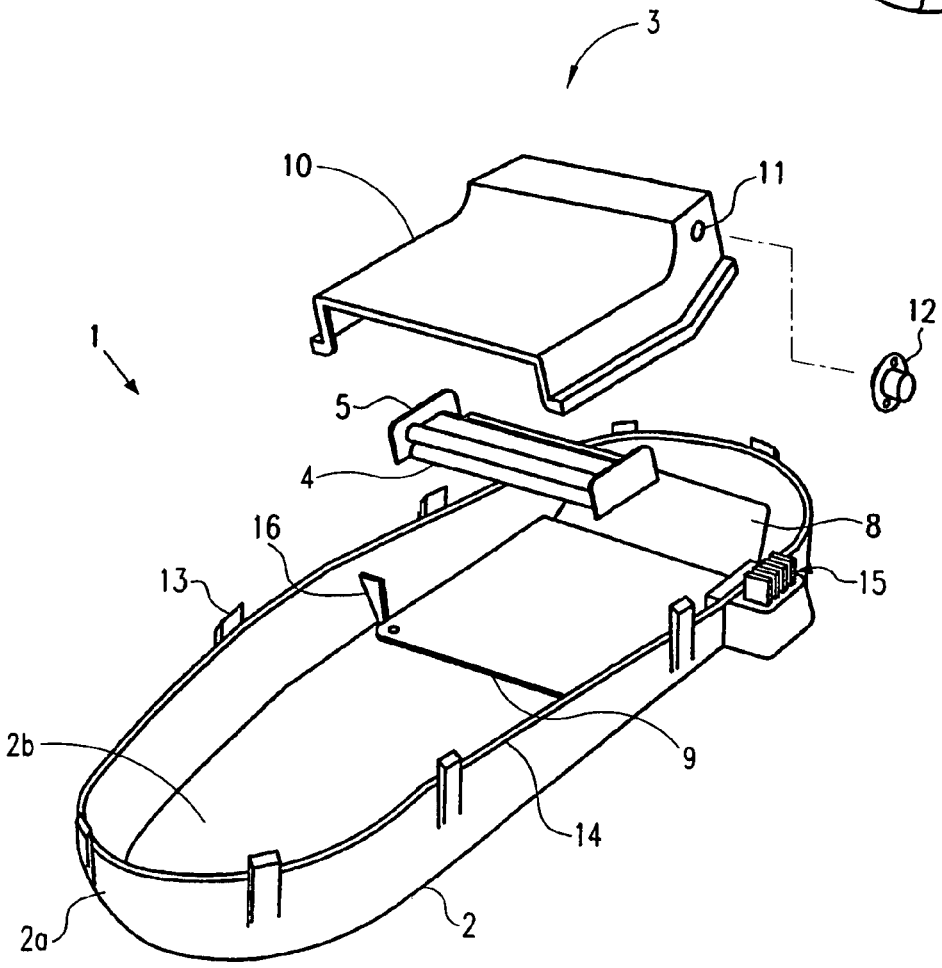
FIG. 3 shows a perspective exploded view of the cover according to the present invention shown in FIG. 1, in a schematic view from above.

First, the general structural design of the cover 1 according to the present invention is described by referring to FIG. 1 to 3 and the exemplary embodiment shown in these figures.

The cover 1, which is adapted as a heating unit, comprises a housing 2, a heat protection body 3 and a plurality of heating elements 4. The exemplary embodiment of the cover according to the present invention shown in FIG. 1 to 3 comprises four heating elements 4 that are arranged side by side and on top of one another. The heating elements 4 are held together by two laterally arranged support plates 5 thus forming a one-piece modular unit. The heating elements 4 are positioned relative to one another such that a gas stream flowing past said heating elements 4 can be heated in the best possible way.

The heating elements 4 are arranged in the interior of the heat protection body 3, which thermally insulates the heating elements from the surroundings and which simultaneously defines a flow passage for guiding a gas stream, preferably an air stream, past said heating elements 4 in the best possible way. The heat protection body 3 is provided with an inlet opening 6 and an outlet opening 7 for this purpose. The air stream to be heated flows into the heat protection body 3 at the inlet opening and, due to the shape of the heat protection body 3, it is conducted through or along the heating elements 4, whereby the air stream will be heated. The heated air stream leaves the heat protection body 3 at the outlet opening 7.

In order to achieve good heat protection, the heat protection body 3 is produced from a corrosion-resistant metal plate, e.g. a chrome nickel steel plate. The heat-shielding effect of the heat protection body 3 is particularly important because temperatures up to 600° C. may occur in the interior of the heat protection body in the area of the heating elements 4. The surface temperature on the outer surface must here not exceed an admissible value, e.g. according to a VDE guideline 85° C. (VDE=Association of German Electricians). A circumstance which makes heat insulation more difficult is that the construction space available is extremely limited. In order to enhance the thermal insulation, the heat protection body can be provided with a reflecting surface according to one embodiment. In addition, the heat protection body 9 has a low thermal conductivity so that the extremely high temperature from the area of the heating elements 4 cannot be transferred to the outer surface of the cover 1. A user can therefore touch the outer surface of the cover 1 without the risk of burning himself.

The heat protection body 3 is adapted e.g. as a two-parted body so as to permit easy pre-assembling of the cover 1 having the heating element 4 premounted therein. The heat protection body 3 comprises a lower part 9 and an upper part 10. In the exemplary embodiment shown in FIG. 1 to 3, the lower part 9 is a punched-out sheet metal component having the guide body 8 formed thereon by means of bending. The upper part 10 of the heat protection body 3 has been produced by deep drawing in the case of the embodiment according to FIG. 1 to 3. The upper part of the heat protection body 3 has formed therein, adjacent the inlet opening 6 and the outlet opening 7, at least one respective recess 11 having provided therein at least one respective temperature sensor 12.

By the temperature sensors 12, the heating of the air stream in the interior of the cover 1 can be measured and the heating power of the heating elements 4 can be controlled. The measured temperature or temperature difference of the air stream can especially be used for establishing a closed-loop control circuit by which the heating elements 4 are actuated and the temperature of the air stream is controlled. In order to improve the closed-loop control circuit, also more than two temperature sensors may be used for sensing the temperature at various points of the air stream. The temperature of the air stream can, for example, be measured in front of and behind the heating element 4. Additionally or alternatively, a further temperature sensor can be arranged close to the heating elements 4 as a safety thermostat so as to detect an excessive temperature rise in the heating elements 4 and prevent overheating in this way. The heat protection body 3 comprising the heating elements 4 is attached to the housing 2.

The housing 2 is provided with fastening means 13 for releasably attaching the cover 1 to a dryer. The fastening means 13 will be described in more detail hereinbelow. The cover 1 additionally comprises a sealing lip 14 by means of which it can be attached to the dryer in a substantially gas-tight manner. This will prevent the heated air stream from being partially discharged to the outside. The housing 2 of the embodiment shown in FIG. 1 to 3 is produced from a heat-insulating plastic material. This is advantageous for preventing, for the reasons mentioned hereinbefore, the high temperature in the area of the heating elements 4 from being transferred to the outer surface of the cover 1. In addition, the housing 2 is produced from an electrically-insulating plastic material to electrically insulate the heating elements 4 from the other parts of the dryer and also from the surroundings. Furthermore, the fact that the housing 2 is produced from an electrically-insulating material will prevent a conduction of creeping currents.

At locations where high temperatures occur, a temperature-resistant material, e.g. a sheet-metal part, can be attached to the housing 2 in the areas in question, so that the housing 2 will be protected in these protective areas.

As shown in FIG. 1 to 3, the housing 2 has the shape of a receptacle and comprises a circumferentially extending receptacle wall 2*a* which encompasses an interior space 2*b*. The cover 1 according to the present invention, in which the heat protection body 3 with the heating elements 4 is provided in the interior space 2*b* without projecting beyond the receptacle wall 2*a*, can thus be attached to a wall 17' of a dryer 17. As can be seen from the figures, said wall 17' can be flat.

The housing 2 of the embodiment of the cover 1 according to the present invention shown in FIG. 1 to 3 is adapted as an injection-moulded part. The manufacturing of the housing in an injection-moulding process has the advantage that a large number of pieces can be manufactured at a reasonable price with high geometrical accuracy.

The cover 1 additionally comprises at least one contact element 15 by means of which the cover 1 with its heating elements 4 and temperature sensors 12 can be electrically connected. The contact element 15 shown in FIG. 1 to 3 is adapted e.g. as a standard connector and integrated in the housing 2. A complementary counter-connector is provided on the dryer so that a plug-connection will automatically be established at the mounted position of the cover 1. Via said contact element 15, both the heating elements 4 and the temperature sensors 12 can be electrically connected. This has the advantage that only one contact element is required for electrically connecting all the components of the cover 1.

The housing 2 is provided with additional fastening means 16 having releasably attached thereto the heat protection body 3. When the cover 1 is being assembled, the lower part 9 of the heat protection body 3 can be lockingly engaged with the additional fastening means 16, which are adapted as a locking means. Subsequently, the pre-assembled modular unit comprising the heating elements 4 and the support plates 5 is attached to the lower part 9. Finally, the upper part 10 of the heat protection body 3 is attached and also lockingly engaged with the additional fastening means 16. The heat protection body 3 can comprise fastening means for fixing the heating elements 4 in the interior of the heat protection body 3. In the embodiment shown in FIG. 1 to 3, the additional fastening means 16 are simultaneously adapted in the form of ribs for increasing the stability of the housing 2.

Figure 5:
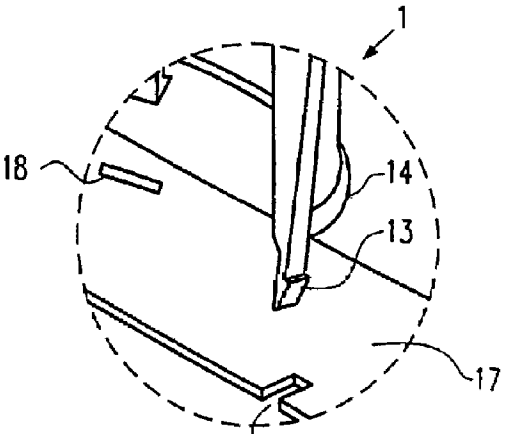
FIG. 5 shows a view of a detail of the cover according to the present invention shown in FIG. 4, prior to its mounting on the clothes dryer.
Figure 6:
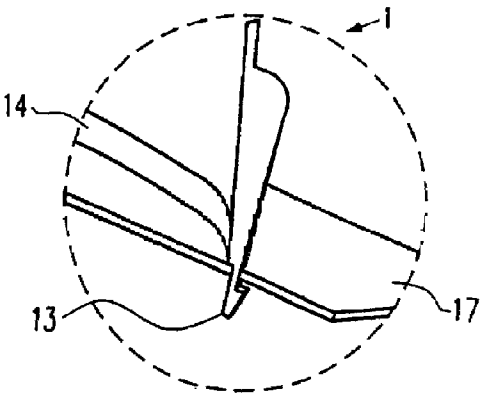
FIG. 6 shows a view of a detail of the cover according to the present invention shown in FIG. 4, after its mounting on the clothes dryer.
Figure 4:
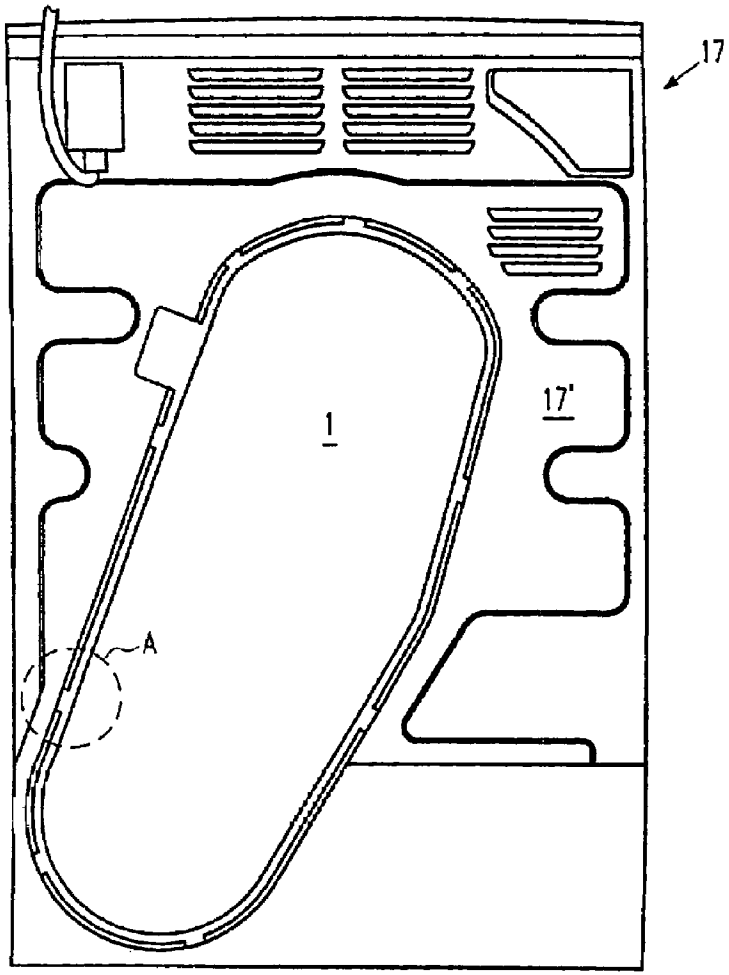
FIG. 4 shows an embodiment of the cover according to the present invention mounted on the rear wall of a clothes dryer.
Figure 8:
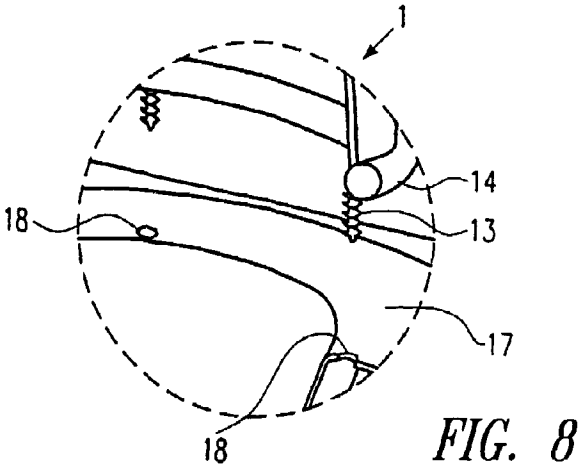
FIG. 8 shows a view of a detail of the cover according to the present invention shown in FIG. 7, prior to its mounting on the clothes dryer.
Figure 9:
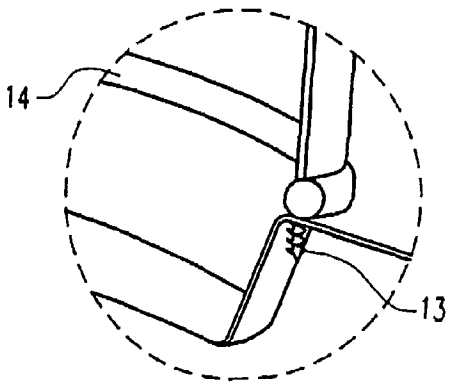
FIG. 9 shows a view of a detail of the cover according to the present invention shown in FIG. 7, after its mounting on the clothes dryer.

FIG. 4 shows the rear wall of a dryer 17 having the cover 1 according to FIG. 1 to 3 of the present invention attached thereto. FIG. 5 and FIG. 8 show a perspective view of detail A of FIG. 4. The cover 1 is here not yet mounted and spaced apart from the dryer 17. The dryer 17 is provided with at least one hole 18 for receiving therein the fastening means 13 of the cover 1. FIG. 6 and FIG. 9 show detail A of FIG. 4 in the mounted condition of the cover 1. The fastening means 13, which is wedge-shaped and implemented as a clip means or a detent mechanism, is locked in position in the hole 18, which is adapted as a counterdetent, in FIG. 6. The sealing lip 14 is compressed in the mounted condition and seals the cover 1 in a substantially air- and gas-tight manner. In addition, the compressed sealing lip 14 produces a tensioning force which urges the dryer 17 away from the cover 1, whereby the fastening means 13 is prevented from rattling in the hole 18 when the dryer is in operation. By this, the cover 1 is mounted on the dryer 17 in a vibration-proof manner.

Figure 7:
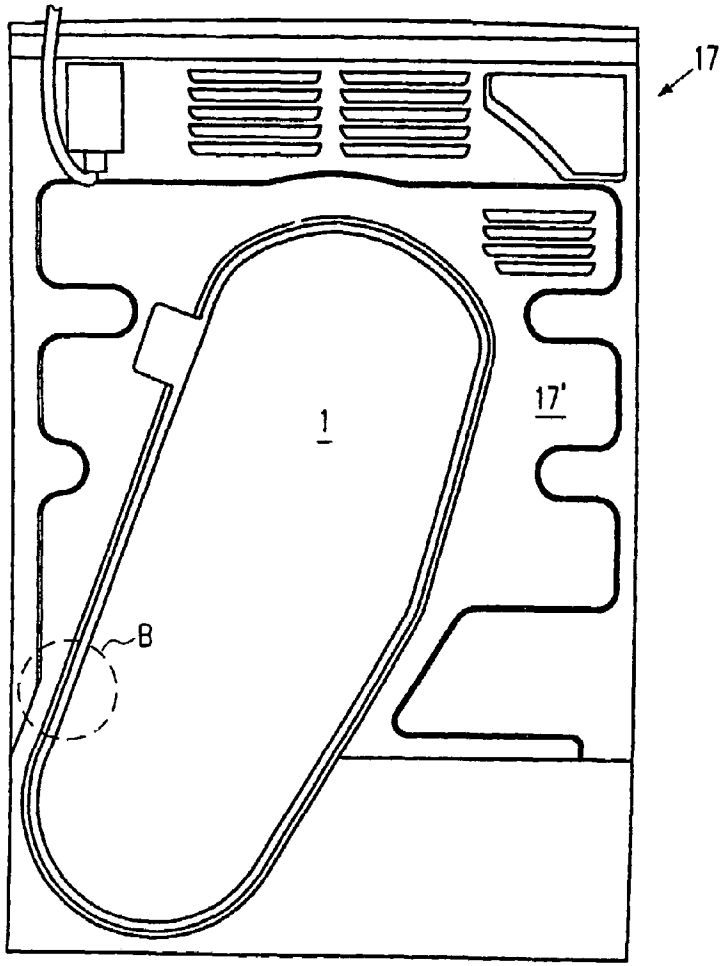
FIG. 7 shows a further embodiment of the cover according to the present invention mounted on the rear wall of a clothes dryer.

FIG. 7 shows a further embodiment of the cover 1 according to the present invention, the cover being mounted on a dryer 17. FIG. 8 shows a detail B of FIG. 7, the cover 1 being shown in a condition in which it is not yet mounted on the dryer 17. In comparison with the embodiment of the cover according to FIG. 4 to 6, the embodiment of the cover 1 according to FIG. 7 to 9 is different insofar as the fastening means 13 have a different structural design and insofar as a different hole 18 is provided. The fastening means 13 shown in FIG. 8 is adapted in the form of a dowel. The hole 18 is circular and adapted as a counterdetent for said fastening means 13. FIG. 9 shows the embodiment of the cover 1 according to FIGS. 7 and 8 in the mounted condition. Similar to the embodiment according to FIG. 4 to 6, the sealing lip 14 is compressed and has the above-described features in the mounted condition.

In the case of the dryer 17 according to the present invention, which is exemplarily shown in FIGS. 5 and 7, the cover 1 is attached to a wall 17' from outside. In the interior of the dryer 17 an air supply, e.g. with a fan, is provided for producing a gas stream by which the wet clothes are dried. The walls 17' are attached e.g. to a basic frame. The cover 1 defines, together with the wall 17', a passage through which the gas stream flows when the dryer 17 is in operation and by which said gas stream can be conducted in the direction of the clothes to be dried.

FIG. 1-3 show one possible embodiment of the cover 1 according to the present invention. The cover 1 can alternatively be provided with a flange area instead of the sealing lip 14. This flange area can be used for fastening the cover 1 to a dryer and it can also serve as a sealing surface with respect to the dryer. For fastening the cover 1, the flange area can have provided therein e.g. holes. Said holes can have arranged therein e.g. screws or rivets to fasten the cover 1 to the dryer. For sealing this embodiment of the cover according to the present invention, a sealing material is applied to said flange area when the cover 1 is mounted on the dryer. When an adhesive sealing material is used, the cover 1 can be attached to the dryer and simultaneously sealed by said sealing material.

The sealing of the cover to the dryer according to the present invention can, alternatively, also be formed as a labyrinth seal.

All of the above U.S. patents, U.S. patent application publications, U.S. patent applications, foreign patents, foreign patent applications and non-patent publications referred to in this specification and/or listed in the Application Data Sheetare incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A clothes dryer preassembly for a clothes dryer having a plurality of outer walls, each outer wall having an outer surface exposed to an environment external to the clothes dryer, the clothes dryer preassembly comprising:

a coupling member including a fastening feature engaging a first portion of a first outer wall of the plurality of outer walls of the clothes dryer to removably couple the clothes dryer preassembly to the first portion of the first outer wall from outside of the clothes dryer, the clothes dryer preassembly constituting a portion of the first outer wall wherein both the first outer wall of the clothes dryer and the clothes dryer preassembly have an outer surface exposed to the environment external to the clothes dryer when the clothes dryer preassembly is coupled to the first portion;

a passage formed at least in part by the clothes dryer preassembly when the clothes dryer preassembly is coupled to the first portion of the first outer wall of the clothes dryer, a gas stream flowing through the passage when the clothes dryer is in operation; and at least one heating element coupled to the clothes dryer preassembly such that the gas stream flows around the heating element when the clothes dryer is in operation, and the heating element is removed from the first outer wall with the clothes dryer preassembly as one unit when the coupling member is disengaged from the first portion of the first outer wall, the clothes dryer preassembly being receptacle-shaped and including a circumferentially extending receptacle wall encompassing an interior space, the interior space forming the passage and being substantially insulated from the external environment, the at least one heating element being positioned in the interior space.

2. The clothes dryer preassembly according to claim 1 wherein the fastening feature includes a detent mechanism to secure the clothes dryer preassembly to the first portion of the first outer wall of the clothes dryer in a desired position.

3. The clothes dryer preassembly according to claim 1, further comprising:

a sealing lip disposed between at least a portion of the clothes dryer preassembly and the first portion of the first outer wall of the clothes dryer to substantially establish a gas-tight attachment between the clothes dryer preassembly and the first portion of the first outer wall.

4. The clothes dryer preassembly according to claim 1, further comprising:

a labyrinth seal disposed between at least a portion of the clothes dryer preassembly and the first portion of the first outer wall of the clothes dryer to substantially establish a gas-tight attachment between the clothes dryer preassembly and the first portion of the first outer wall.

5. The clothes dryer preassembly according to claim 1 wherein the clothes dryer preassembly is produced from a heat-insulating material.

6. The clothes dryer preassembly according to claim 1 wherein the clothes dryer preassembly is produced from a temperature-resistant material.

7. The clothes dryer preassembly according to claim 1 wherein the clothes dryer preassembly is produced from an electrically insulating material.

8. The clothes dryer preassembly according to claim 1, further comprising:

at least one temperature sensor positioned to sense a temperature of the gas stream.

9. The clothes dryer preassembly according to claim 1, further comprising:

a heat protection body which at least partially surrounds the at least one heating element.

10. The clothes dryer preassembly according to claim 9 wherein the heat protection body defines a flow passage through which the gas stream can flow.

11. The clothes dryer preassembly according to claim 9 wherein the heat protection body is produced from a temperature-resistant material.

12. The clothes dryer preassembly according to claim 1, further comprising:

at least one contact element in electrical communication with the heating unit and configured to be electrically coupled to a mating contact.

13. The clothes dryer preassembly according to claim 12 wherein the contact element is adapted as part of a plug-connection.

14. The clothes dryer preassembly according to claim 12 wherein the contact element is coupled to the clothes dryer preassembly.

15. The clothes dryer preassembly according to claim 1 wherein at least a portion of the clothes dryer preassembly is plastic with at least one protective area made from a material different from plastic.

16. The clothes dryer preassembly according to claim 15 wherein the at least one protective area is located in a region of the clothes dryer preassembly where high temperatures occur when the dryer is in operation.

17. A method for assembling a clothes dryer that is operable to heat a gas stream for drying clothes and that includes a plurality of outer walls each having an outer surface exposed to an environment external to the clothes dryer, the method comprising:

coupling at least one heating element into clothes dryer preassembly including a coupling member having a fastening feature; and engaging the fastening feature to a first portion of a first outer wall of the plurality of outer walls of the clothes dryer to removably attach the clothes dryer preassembly to the first portion of the first outer wall from outside of the clothes dryer, the clothes dryer preassembly constituting a portion of the first outer wall such that both the first outer wall of the cloths dryer and the clothes dryer preassembly have an outer surface exposed to the environment external to the cloths dryer when the cloths dryer preassembly is coupled to the first portion, wherein the clothes dryer preassembly is receptacle-shaped and includes a circumferentially extending receptacle wall encompassing an interior space, the interior space being substantially insulated from the external environment, the at least one heating element being positioned in the interior space, coupling of the clothes dryer preassembly to the first portion of the first outer wall forming a passage including the interior space through which a gas stream flows around the heating element when the clothes dryer is in operation, and disengaging the coupling member from the first portion of the first outer wall allows removal of the heating element and the clothes dryer preassembly from the first outer wall, as one unit.

18. The method according to claim 17, further comprising:

closing a contact for supplying power to the heating element when the clothes dryer preassembly is releasably attached to the first portion of the first outer wall of the clothes dryer wherein closing the contact is automatically established when the clothes dryer preassembly is removably attached to the first outer wall.

19. The method according claim 17, further comprising:

providing a seal between at least a portion of the clothes dryer preassembly and the outer wall of the clothes dryer.

20. A clothes dryer operable to heat a gas stream for drying clothes, the clothes dryer comprising:

a plurality of outer walls each having an outer surface exposed to an environment external to the clothes dryer;

a clothes dryer preassembly removably coupled to a first portion of a first outer wall of the clothes dryer and constituting a portion of the first outer wall, the clothes dryer preassembly including;

a coupling member including a fastening feature engaging the first portion of the first outer wall of the plurality of outer walls of the clothes dryer to removably couple the clothes dryer preassembly to the first portion of the first outer wall from outside of the clothes dryer, the clothes dryer preassembly constituting a portion of the first outer wall wherein both the first outer wall of the clothes dryer and the clothes dryer preassembly have an outer surface exposed to the environment external to the clothes dryer when the clothes dryer preassembly is coupled to the first portion;

a passage formed at least in part by the clothes dryer preassembly when the clothes dryer preassembly is coupled to the first portion of the first outer wall of the clothes dryer, a gas stream flowing through the passage when the clothes dryer assembly is in operation; and at least one heating element coupled to the clothes dryer preassembly such that the gas stream flows around the heating element when the clothes dryer is in operation, and the heating element is removed from the first outer wall with the clothes dryer preassembly as one unit when the coupling member is disengaged from the first portion of the first outer wall, the clothes dryer preassembly being receptacle-shaped and including a circumferentially extending receptacle wall encompassing an interior space, the interior space forming the passage and being substantially insulated from the external environment, the at least one heating element being positioned in the interior space.

* * * * *